US006450671B1

(12) United States Patent
Scholz et al.

(10) Patent No.: US 6,450,671 B1
(45) Date of Patent: Sep. 17, 2002

(54) MEDICAL LIGHTING UNIT

(75) Inventors: Manfred Scholz, Seitingen-Oberflacht; Martin Braig, Tuttlingen, both of (DE)

(73) Assignee: Gebrueder Berchtold GmbH & Co., Tuttlingen (DE)

( * ) Notice: Subject to any disclaimer, the term of this patent is extended or adjusted under 35 U.S.C. 154(b) by 0 days.

(21) Appl. No.: 09/473,476

(22) Filed: Dec. 28, 1999

(30) Foreign Application Priority Data

Dec. 30, 1998 (DE) ..... 198 60 800

(51) Int. Cl.[7] ..... F21V 21/36

(52) U.S. Cl. ..... 362/403; 362/572; 362/33; 362/147; 362/285; 362/286; 362/404; 362/391; 362/386

(58) Field of Search ..... 362/403, 572, 362/33, 147, 148, 285, 404, 804, 386, 391, 286

(56) References Cited

U.S. PATENT DOCUMENTS 3,240,925 A * 3/1966 Paschke ..... 362/572
3,653,318 A * 4/1972 Shimosawa ..... 98/115
4,466,792 A * 8/1984 Ballabene et al. ..... 432/122

FOREIGN PATENT DOCUMENTS

DE 482362 9/1929
DE 727206 10/1942
DE 1797040 2/1972

* cited by examiner

*Primary Examiner*—Thomas M. Sember
*Assistant Examiner*—Ali Alavi
(74) *Attorney, Agent, or Firm*—Townsend and Townsend and Crew LLP

(57) ABSTRACT

The invention relates to a medical lighting unit for clinical use comprising a lighting unit body containing at least one lamp and having at least one light outlet side, with the lighting unit body being vertically adjustably mounted on at least one flexible, coilable tensile carrying element supported on a room wall, in particular on the room ceiling. The tensile carrying element is connected at one end to the lighting unit body and at the other end to a drive unit secured to the room wall and containing a drive motor for extending and retracting the tensile carrying element, with the tensile carrying element extending vertically between the drive unit and the lighting unit body. The invention lies in the fact that the carrying element is a single chain with measures being taken, or means being provided, in order to be able to set the lighting unit body in a desired illuminating position despite the single chain suspension.

26 Claims, 2 Drawing Sheets

MEDICAL LIGHTING UNIT

FIELD OF THE INVENTION

The invention relates to a medical lighting unit for clinical use comprising a lighting unit body containing at least one lamp and having at least one light outlet side, the lighting body unit being vertically adjustably mounted on at least one flexible and coilable tensile carrying element on a wall of a room, in particular on the ceiling of a room. The carrying element is secured at one end to the lighting unit body and at the other end to a drive unit secured to the room wall. The drive unit contains a drive motor for extending and retracting the tensile carrying element and extending vertically between the drive unit and the lighting unit body.

BRIEF DESCRIPTION OF THE PRIOR ART

For operations in medical facilities such as clinics, hospitals or the like, lighting units with a particularly high light intensity of more than 70000 to 100000 Lux are required for the illumination of the position where the operation is to be carried out because human tissue, especially bloody tissue, absorbs a large part of the light. As a result, lighting units are known in operating theaters which are, as a rule, fixedly installed above the operating table and are movable, rotatable and liftable/lowerable by means of pivotal arms or spring arms.

For investigations on patients there are smaller examination lighting units in which the technical lighting requirements such as the intensity of the illumination, the color temperature or the like do not have to satisfy the stringent requirements of the operating theater lamp.

A special application for such lighting units are problematic births in gynecological clinics. In this arrangement the patients are frequently transported out of the actual delivery room, previously termed a labor ward, into an operating theater. This movement is not opportune for two reasons. On the one hand, an increased risk for the patient exists, especially in risky situations as a result of the transport and of the time which is lost. On the other hand, the patients increasingly wish to be able to give birth not in a labor ward, but rather in a separate individual room. This room should be cozily designed, since a normal birth is not a case of a surgical operation. Through the accommodation in individual rooms, the distances to the operating theater are, however, even larger in the case of an emergency.

Thus, there are already installations in individual patient rooms which permit smaller emergency operations such as cuts, sutures and other manipulations of a surgical nature. This additional technical equipment should not be visible in the normal case and should above all not hinder the mobility of people within the room. Since good lighting is required for such actions, of a similar quality to that of the operating theater, lighting installations are known which can, for example, transmit intense light rays to the patient's bed, for example from the ceiling region or from the wall. However, such installations have the disadvantage that they are mainly rigidly arranged and secondly much light is lost through the large distance, for example between the ceiling and the patient's bed.

A lighting unit is known in the non-medical field of application (EP0757204 B1) which can be lowered from the ceiling or lifted up to the ceiling, again by means of a motor and cables. This apparatus is, however, not particularly suitable for the medical application discussed, because two spaced-apart support wires are required between the drive unit and the lighting unit, which greatly impair the accessibility of the space above the lighting unit. A further disadvantage of the known lighting unit lies in the fact that it can only radiate light downwardly and cannot be adjusted other than in an upward and downward movement.

PRINCIPAL OBJECT OF THE INVENTION

The object of the present invention is, on the one hand, to provide a medical lighting unit of the initially named kind which can be moved with a motor in a simple manner from a parking position close to the ceiling into a lower working position, without too much space being required above the lighting unit body for the tensile carrying element. The lighting unit should have operating theater light qualities, i.e. high luminous intensities and a color temperature close to that of daylight. Furthermore, the lighting unit body should be adjustable in a manner which is as universal as possible in all vertical settings other than the parking position, in order to be able to set an ideal luminating position, not only by suitable vertical adjustment, but rather also by tilting of the lighting unit body.

BRIEF SUMMARY OF THE INVENTION

In order to satisfy this object the carrying element is realized as a single chain with measures or means being provided in order to set the lighting unit body in a desired illuminating position despite the single chain suspension.

The concept underlying the invention is thus to be seen in the fact that no longer a plurality of tensile carrying elements but rather, on the contrary, only a single chain is provided for the upwardly and downwardly movable support of the lighting unit body. A single chain requires considerably less space above the lighting unit body than a plurality of tensile carrying elements. However, measures must be taken, or means must be provided, in order to be able to set the desired lighting position of the lighting unit body. In accordance with the invention the lighting unit body has, in addition to the lamp, also an in built reflector, so that a high light intensity is ensured by light bundling.

In a preferred embodiment the chain acts laterally outside of the center of gravity of the lighting unit body on the latter, preferably at the outer edge of the lighting unit body on the latter, and consists of links which, with vertical alignment of the chain relative to the adjacent links, cannot be pivoted away from the lighting unit body.

This embodiment is particularly advantageous, since in this way the space above the lighting unit body is completely free from carrying elements and the single chain only extends upwardly to the drive unit from one side of the lighting unit body. As a result of the special design of the links of the chain, a situation is achieved in which the weight of the lighting unit body stiffens the chain so that it acts in a more or less downwardly extending state as a rigid bar. The chain is thus simultaneously a mounting element and a transport element which holds the lighting unit body in a defined position. Through the single chain, the lighting unit body can be moved by a motor between the parking position close to the ceiling and its working position.

In a particularly preferred embodiment the links can only be pivoted relative to the adjacent links in the direction towards the lighting unit body when the chain is vertically aligned.

Moreover, the neighboring links of the chain are pivotable relative to one another about only a single axis respectively pointing in the same direction, and indeed with a straight arrangement of the chain only in a direction deviating from the straight line direction, in which the lighting unit body is located.

These embodiments signify that the chain can be curved or bent only in a single plane, which leads to a particularly high stability of the vertically extending part of the chain.

In an advantageous further development of the invention an end piece to which the lighting unit body is attached at the side is secured to the lower end of the chain. This medical lighting unit is preferably characterized in that an at least substantially horizontal holding stub of the lighting unit body is secured to the lowermost link of the chain or to the end piece at the side. In this way the lighting unit body can be reliably secured to the lower end of the chain.

The lighting unit body is preferably movably secured to the chain, or to the end piece by a cardan joint. In particular a cardan hoop is preferably arranged between the lighting unit body and the holding stub. These embodiments ensure a universal adjustability of the lighting unit body secured to the lower end of the chain. In conjunction with the vertical adjustment the most diverse lighting positions of the lighting unit body can thus be realized.

The cable for the power supply of the lamp is arranged on or in the chain. I.e. the chain can simultaneously be used for the power supply to the lamp of the lighting unit body.

The lighting unit body is preferably accommodated in its highest position in a recess of the drive unit. In this way the light is not particularly apparent in the parked state and acts in similar manner to a normal ceiling lamp.

A preferred operating measure for the medical lighting unit of the invention is characterized in that an operating keyboard and an electronic control system for the introduction of an upward or downward movement of the lighting unit body are provided. In this arrangement a brief key actuation at the operating keyboard is sufficient, in a position between the highest position or parking position of the lighting unit body and a position in the lower range of movement of the latter, for example at two-thirds of the total range of movement from above, in order to displace the lighting unit body over this path.

A slow and in particular small step-wise upward and downward movement of the lighting unit body can preferably be initiated by key actuation in a range of movement (working range) lying in the vicinity of the lowermost position of the vertical adjustment.

The upward movement of the lighting unit body into the parking position by key actuation is blocked until the lighting unit body has been brought into the basic position, in particular a horizontal basic position, which it at least substantially adopts in the parking position.

An arrangement in which the chain extends vertically above the lowermost link over at least a few links in the parking position of the lighting unit body before a deflection takes place is particularly preferred, since in this way an adequate length of vertical chain is preferably provided within the drive unit. This ensures, as a result of the vertical guidance, that the vertical part of the chain projecting downwardly out of the drive unit is not pivoted by the eccentrically acting weight of the lighting unit body out of the vertical position. The uppermost part of the vertical range of the chain should preferably consist of at least a few links, preferably three to 10 links, and in particular four to six links and especially expediently five links, and is so vertically guided, preferably inside the drive unit, that an otherwise possible pivoting away movement of the lighting unit body about an axis in the region of the upper deflection of the chain within the drive unit is avoided.

A precondition for the action of the vertical part of the chain as a rigid bar is thus that the uppermost part of the chain is precisely vertically guided inside the drive unit against deflection as a result of the weight of the lighting unit body. In a particularly preferred embodiment the drive unit is accommodated between the room ceiling and a false ceiling arranged at a distance beneath it and the false ceiling has an opening for the emergence through it of the lower surface of the drive unit, such that the vertically upwardly moved lighting unit body appears to be integrated into the false ceiling.

One embodiment of the present invention permits the drive unit to be accommodated largely unseen, so that the upwardly moved lighting unit body appears to be integrated into the intermediate ceiling or false ceiling.

BRIEF DESCRIPTION OF THE DRAWINGS

The invention will be described in the following by way of example and with reference to the drawing, in which are shown.

DESCRIPTION OF PREFERRED EMBODIMENT

Figure 1:
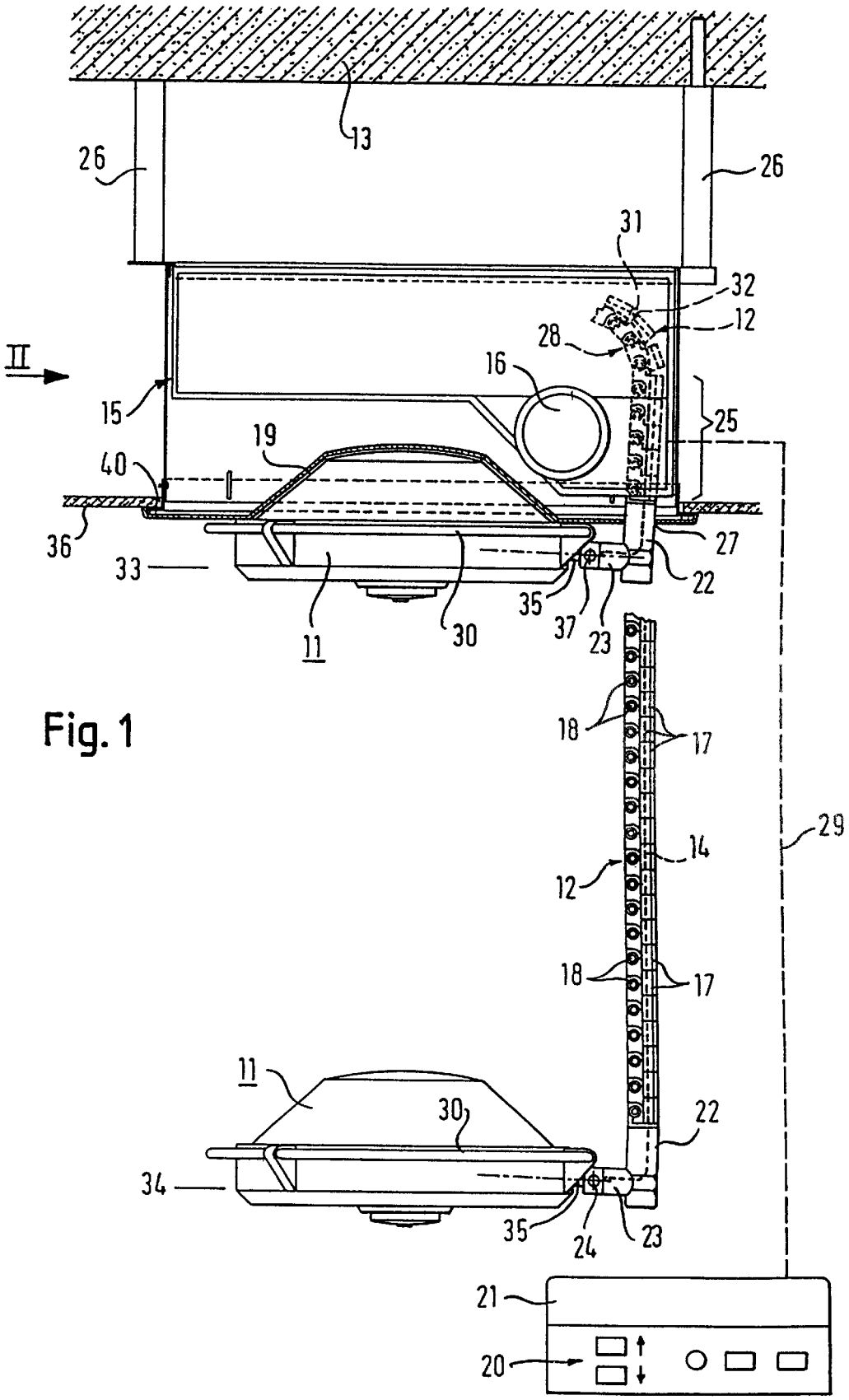
FIG. 1 is a side view of a medical lighting unit in accordance with the invention secured to a room ceiling, with both the parking position and also a lower working position being illustrated.
Figure 2:
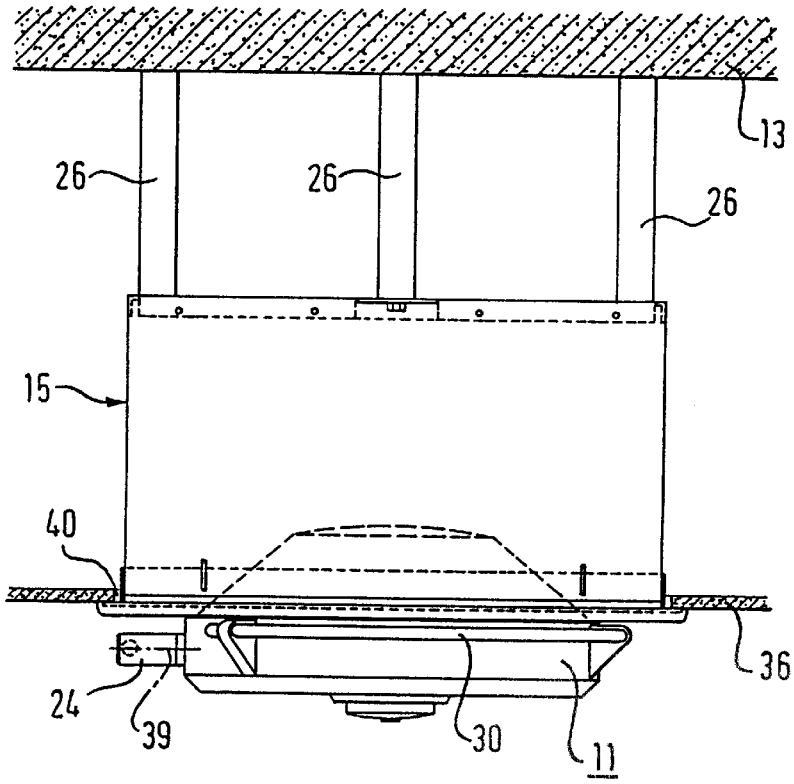
FIG. 2 is a view of the lighting unit of the invention in the direction of the arrow II in FIG. 1, with only the upper parking position of the lighting unit body being shown.

In accordance with the drawing, a box-like drive unit 15 is secured to the ceiling 13 of a sickroom via vertical supports 26 and extends downwardly up to an intermediate or false ceiling 36, in which an opening 40 is provided in which the lower surface of the drive unit 15 is accommodated at least substantially flush with the underside of the false ceiling 36. Within the drive unit 15 there is arranged a single chain 12 which emerges downwardly at one side out of a lower opening 27 and which merges from a vertical region 25 within the opening 27 into a curved region 28. From there the chain leads in a non-illustrated manner to a chain winding device which can be driven in the one or other direction of rotation by a purely schematically indicated drive motor 16. The drive can be controlled by an operator via an operating keyboard 20 with attached electronic control system 21, which is connected to the drive unit 25 via a control line 29. The operating keyboard 20 with the electronic control system 21 is preferably incorporated into a non-illustrated wall box.

Figure 3:
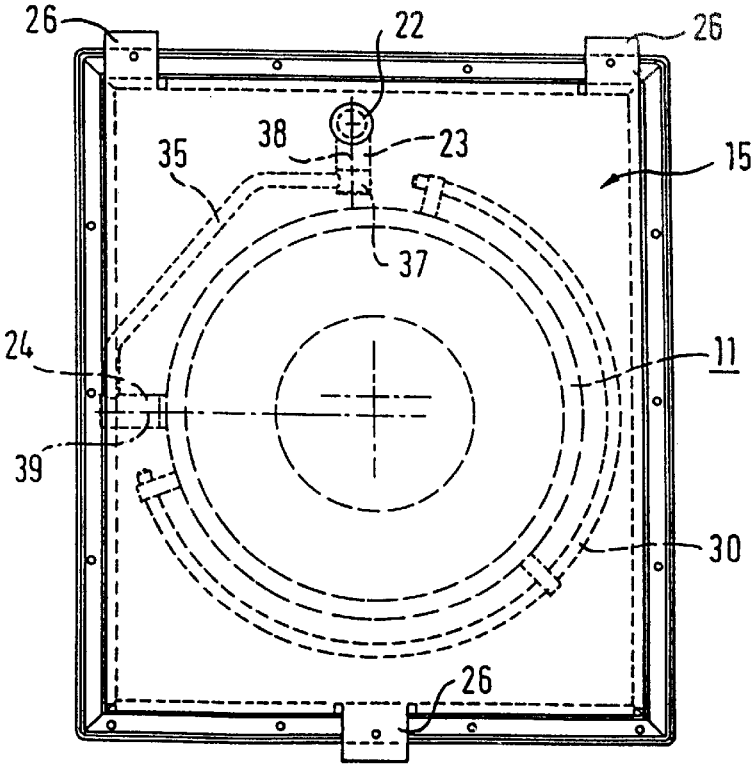
FIG. 3 is a schematic plan view of the subject of FIG. 2.

An end piece 22 is secured to the lower end of the chain 12 and a substantially horizontally arranged holding stub 23 at the side of the lighting unit body 11 is secured to the end piece 22. An end member 37 of a cardan hoop 35 (FIG. 3) is adjustably mounted about a horizontal axis 38 on the holding stub 23, with the extension of the horizontal axis extending approximately through the center of the lighting unit body 11. The cardan hoop surrounds the lighting unit body 11 over about 90° (in the counter-clockwise sense in FIG. 3) and is there adjustably connected via a joint 24 with a horizontal axis of rotation 39 extending perpendicular to the axis 38 to the periphery of the lighting unit body 11. In this manner a universal pivoting of the lighting unit body 11 about the axes 38, 39 is possible. For the exertion of suitable tilting forces, a railing-like actuating hoop 30 is provided at the periphery of the lighting unit body 11.

In the interior of the lighting unit body 11 there is located a non-illustrated lamp, the light of which is deflected via a reflector to the downwardly provided outlet side.

A cable 14 extending parallel to the chain 12 and only indicated in broken lines is provided at the chain 12 and ensures the power supply for the lamp located in the lighting unit body 11 via a mains connection provided in the drive unit 15. The switching on and off of the lamp can be effected from the operating keyboard 20.

In accordance with the invention the chain 12 consists of individual links 17 which are only pivotable about a single axis 18 relative to one another. Adjacent links 17 of the chain 12 have, at a distance from the axis 18 remote from the lighting unit body 11, cooperating abutment surfaces 31 and 32 which are spaced apart within the range of curvature 28 shown in FIG. 1 but which, in the vertical region of the chain 12, including the uppermost part 25, come into contact with one another so that the chain links in the view of FIG. 1 can only be pivoted in the clockwise sense in the vertical region, but not, however, in the counter-clockwise sense.

In the uppermost position 33 of the lighting unit body 11 shown in FIG. 1 the latter is located in a recess 19 of the drive unit 15, so that the lighting unit body acts as a normal room light.

If now a knob is pressed on the operating keyboard 20 which triggers the movement of the chain 12 downwardly, then the electric motor 16 drives the chain 12 in the corresponding direction and unwinds it from the non-illustrated winding up device. The chain 12 then moves downwardly taking the lighting unit body 11 with it until finally the lower position 34 shown in FIG. 1 is reached. During the downward movement the inherent weight of the lighting unit body 11 participates as a driving force, which must be taken into account in the generation of the drive force of the electric motor 16. The electric motor 16 and any eventually provided transmissions must therefore be able to brake the downward movement of the chain 12. The design of the chain link 17 in accordance with the invention, which ensures, in conjunction with the eccentrically acting weight of the lighting unit body 11, that the chain 12 behaves practically like a rigid rod to which the lighting unit body 11 is secured sideways at the bottom, is decisive in ensuring the fact that the lighting unit body 11 retains the horizontal position adopted in the upper position 33 during this downward movement.

For the vertical alignment of the chain 12 beneath the drive unit 15 it is furthermore important that the uppermost portion 25 of the vertical part of the chain 12 is so vertically guided within the drive unit that a deflection of the chain 12 (to the right in FIG. 1) is impossible in this region.

Whereas the chain 12 behaves in conjunction with the eccentrically mounted lighting unit body 11 as a rigid bar, the chain 12 can straightforwardly curve in the customary manner in the opposite direction, as is indicated in the illustrated curved region 28. In this manner the coiling up and stowage of the chain within the drive unit 15 is possible.

The operating keyboard 20 and the electronic control system 21 can embody the following special features:

Measures can be taken for the lighting unit to be moved upwardly and downwardly automatically and relatively quickly in the upper two-thirds of its range of movement by a brief pressing of a key of the operating keyboard 20, so that the parked position and the lower position close to the working position can be reached quickly. In the vicinity of the lower working position a slow upward and downward movement should then be possible, which can also take place in small steps.

The adjustment of the lighting unit body 11 by tilting and pivoting in each direction takes place manually, for example by means of the cardan mechanism 24.

Furthermore, a situation can be achieved, by a non-illustrated suitable sensor or a plurality of sensors, in which an upward movement of the lighting unit body 11 into the parking position 33 can only be triggered by a key when the lighting unit body 11 has previously been brought by a suitable manual pivoting into that preferably horizontal position which it adopts within the recess 19 of the drive unit 15.

What is claimed is:

1. A medical lighting unit for clinical use, the medical lighting unit comprising a lighting unit body containing at least one lamp and having at least one light outlet side, the lighting body unit being vertically adjustably mounted on at least one flexible and coilable tensile carrying element on a wall of a room, the carrying element being secured at one end to the lighting unit body and at another end to a drive unit secured to the room wall and containing a drive motor for extending and retracting the tensile carrying element and extending vertically between the drive unit and the lighting unit body, wherein the carrying element is a single chain configured to set the lighting unit body in a desired illuminating position despite the single chain suspension, and wherein the chain acts laterally outside of the center of gravity of the lighting body, the chain consisting of links that, with vertical alignment of the chain relative to the adjacent links, cannot be pivoted away from the lighting unit body.

2. A medical lighting unit in accordance with claim 1 wherein the chain acts laterally at the outer edge of the lighting body on the lighting unit body.

3. A medical lighting unit in accordance with claim 1 wherein when the chain is vertically aligned the links can only be pivoted relative to adjacent links in a direction towards the lighting unit body.

4. A medical lighting unit in accordance with claim 1 wherein neighboring links of the chain are pivotable relative to one another about only a single axis respectively pointing in the same direction.

5. A medical lighting unit in accordance with claim 4 wherein with a straight arrangement of the chain the neighboring links are pivotable relative to one another only in a direction deviating from a straight-line direction in which the lighting unit body is located.

6. A medical lighting unit in accordance with claim 1 wherein an end piece to which the lighting unit body is attached at the side is secured to a lower end of the chain.

7. A medical lighting unit in accordance with claim 1 wherein an at least substantially horizontal holding stub of the lighting unit body is secured to the lowermost link of the chain or to the end piece at the side.

8. A medical lighting unit in accordance with claim 1 wherein the lighting unit body is cardanically movably secured to the chain or to the end piece.

9. A medical lighting unit in accordance with claim 8 wherein a cardanic hoop is arranged between the lighting unit body and the holding stub.

10. A medical lighting unit in accordance with claim 1 wherein a cable for the power supply of the lamp is arranged on or in the chain.

11. A medical lighting unit in accordance with claim 1 wherein the lighting unit body is accommodated in its highest position in a recess of the drive unit.

12. A medical lighting unit in accordance with claim 1 further comprising an operating keyboard and an electronic control system for the introduction of an upward or downward movement of the lighting unit body.

13. A medical lighting unit in accordance with claim 12 wherein a brief key actuation at the operating keyboard is sufficient between the highest position or parking position of the lighting unit body and a position in the lower range of movement of the latter in order to displace the lighting unit body over this path.

14. A medical lighting unit in accordance with claim 1 wherein a slow and small stepwise upward and downward movement of the lighting unit body may be initiated by key actuation in a range of movement (working range) lying in the vicinity of the lowermost position of the vertical adjustment.

15. A medical lighting unit in accordance with claim 1 wherein the upward movement of the lighting unit body into the parking position by key actuation is blocked until the lighting unit body has been brought into a basic position which it at least substantially adopts in the parking position.

16. A medical lighting unit in accordance with claim 15 wherein the basic position is a horizontal basic position.

17. A medical lighting unit in accordance with claim 1 wherein the chain extends vertically above a lowermost link over at least a few links in a parking position of the lighting unit body before a deflection takes place.

18. A medical lighting unit in accordance with claim 1 wherein an uppermost part of the vertical range of the chain consisting of at least a few links is so vertically guided that an otherwise possible pivoting away movement about an axis in a region of the upper deflection of the chain within the drive unit is avoided.

19. A medical lighting unit in accordance with claim 18 wherein the at least a few links is three to ten links.

20. A medical lighting unit in accordance with claim 19 wherein the at least a few links is four to six links.

21. A medical lighting unit in accordance with claim 20 wherein the at least a few links is five links.

22. A medical lighting unit in accordance with claim 18 wherein the uppermost part is vertically guided inside the drive unit.

23. A medical lighting unit in accordance with claim 1 wherein the drive unit is accommodated between the room ceiling and a false ceiling arranged at a distance beneath it, the false ceiling having an opening for the emergence through it of the lower surface of the drive unit such that the vertically upwardly moved lighting unit body appears to be integrated into the false ceiling.

24. A medical lighting unit for clinical use, the medical lighting unit comprising a lighting unit body containing at least one lamp and having at least one light outlet side, the lighting body unit being vertically adjustably mounted on at least one flexible and coilable tensile carrying element on a wall of a room, the carrying element being secured at one end to the lighting unit body and at another end to a drive unit secured to the room wall and containing a drive motor for extending and retracting the tensile carrying element and extending vertically between the drive unit and the lighting unit body, wherein the carrying element is a single chain configured to set the lighting unit body in a desired illuminating position despite the single chain suspension, and wherein an at least substantially horizontal holding stub of the lighting unit body is secured to the lowermost link of the chain or to the end piece at the side.

25. A medical lighting unit for clinical use, the medical lighting unit comprising a lighting unit body containing at least one lamp and having at least one light outlet side, the lighting body unit being vertically adjustably mounted on at least one flexible and coilable tensile carrying element on a wall of a room, the carrying element being secured at one end to the lighting unit body and at another end to a drive unit secured to the room wall and containing a drive motor for extending and retracting the tensile carrying element and extending vertically between the drive unit and the lighting unit body, wherein the carrying element is a single chain configured to set the lighting unit body in a desired illuminating position despite the single chain suspension, and wherein a brief key actuation at the operating keyboard is sufficient between the highest position or parking position of the lighting unit body and a position in the lower range of movement of the latter in order to displace the lighting unit body over this path.

26. A medical lighting unit for clinical use, the medical lighting unit comprising a lighting unit body containing at least one lamp and having at least one light outlet side, the lighting body unit being vertically adjustably mounted on at least one flexible and coilable tensile carrying element on a wall of a room, the carrying element being secured at one end to the lighting unit body and at another end to a drive unit secured to the room wall and containing a drive motor for extending and retracting the tensile carrying element and extending vertically between the drive unit and the lighting unit body, wherein the carrying element is a single chain configured to set the lighting unit body in a desired illuminating position despite the single chain suspension, and wherein the chain extends vertically above a lowermost link over at least a few links in a parking position of the lighting unit body before a deflection takes place.

* * * * *